US005143540A

United States Patent [19]

Pyzik et al.

[11] Patent Number: 5,143,540

[45] Date of Patent: Sep. 1, 1992

[54] DENSIFICATION OF CERAMIC-METAL COMPOSITES

[75] Inventors: Aleksander J. Pyzik; Irving G. Snyder, Jr., both of Midland; Robert R. McDonald, Traverse City, all of Mich.; Alexander Pecnenik, Los Angeles, Calif.

[73] Assignee: The Dow Chemical Company, Midland, Mich.

[21] Appl. No.: 584,548

[22] Filed: Sep. 18, 1990

Related U.S. Application Data

[62] Division of Ser. No. 143,560, Jan. 13, 1988, Pat. No. 4,961,778.

[51] Int. Cl.[5] ..... C22C 29/12; C22C 29/06; C22C 29/14; C04B 35/52

[52] U.S. Cl. ..... 75/233; 75/232; 75/234; 75/235; 75/236; 75/237; 75/238; 75/241; 75/242; 75/244; 501/87; 501/88; 501/89; 501/90; 501/92; 501/93; 501/108; 501/127; 501/134; 501/128

[58] Field of Search ..... 75/230, 236, 237, 238, 75/232, 233, 234, 235, 241, 242, 244, 245, 246, 247; 501/87, 88, 89, 90, 92, 93, 108, 127, 134, 128

[56] References Cited

U.S. PATENT DOCUMENTS

| | | | |
|---|---|---|---|
| 3,864,154 | 2/1975 | Gazza et al. | 75/254 |
| 4,718,941 | 1/1988 | Halverson et al. | 75/236 |
| 4,777,014 | 10/1988 | Newkirk et al. | 75/244 X |
| 4,885,130 | 12/1989 | Claar et al. | 75/236 X |
| 4,904,446 | 2/1990 | White et al. | 419/13 |
| 4,961,778 | 10/1990 | Pyzik et al. | 75/230 |

*Primary Examiner*—Brooks H. Hunt
*Assistant Examiner*—Daniel J. Jenkins

[57] ABSTRACT

Substantially dense, void-free ceramic-metal composites are prepared from components characterized by chemical incompatibility and non-wetting behavior. The composites have a final chemistry similar to the starting chemistry and microstructures characterized by ceamic grains similar in size to the starting powder and the presence of metal phase. A method for producing the composites requires forming a homogeneous mixture of ceramic-metal, heating the mixture to a temperature that approximates but is below the temperature at which the metal begins to flow and pressing the mixture at such pressure that compaction and densification of the mixture occurs and an induced temperature spike occurs that exceeds the flowing temperature of the metal such that the mixture is further compacted and densified. The temperature spike and duration thereof remains below that at which significant reaction between metal and ceramic occurs. The method requires pressures of 60–250 kpsi employed at a rate of 5–250 kpsi/second.

9 Claims, 10 Drawing Sheets

$SiB_6/SiB_4$ - 30 VOL. % Al $B_4C$ – 30 VOL. % Al $SiB_6/SiB_4$ – 30 VOL. % Al

SiC-50 VOL. % Al

DENSIFICATION OF CERAMIC-METAL COMPOSITES

CROSS-REFERENCE TO RELATED APPLICATION

This application is a division of 07/143,560, filed Jan. 13, 1988, which is now U.S. Pat. No. 4,961,778.

BACKGROUND OF THE INVENTION

The present invention relates to dense, ceramic-metal composites that approach theoretical density and methods for producing them. More particularly, the invention relates to ceramic-metal composites that are formed of chemically incompatible components that also may exhibit non-wetting behavior.

Ceramic materials are combined with metals to form composite compositions that exhibit exceptional hardness and toughness yet are often light in weight in comparison with metals. Achieving the best potential characteristics for any ceramic-metal composite requires that the composite produced is substantially void-free and capable of achieving theoretical density for a given starting mixture. Also, since a key advantage of such ceramic-metal composites is hardness, it is desirable to maximize the ceramic component content Preferably, at least 50 percent by volume of the composite composition is ceramic which composition has been difficult to fully densify heretofor. The metal component lends toughness to the ceramic-metal composite and is additionally a key element in obtaining void-free densification. It is also desirable that the finished densified compact is substantially similar chemically and in ceramic grain size to the starting mixture. Such similarity is important to achieving composites that have predictable and uniform characteristics.

Obtaining fully densified ceramic-metal composites for such mixtures has not been achieved in the past because of the relatively difficult nature of combinations of the ceramics and metals of interest. Many of the metals and ceramics are non-wetting and thus difficult to fully densify by processes that require metal flow under influence of capillary forces into the voids between ceramic particles. Also, many of the ceramics and metals are "incompatible", in the sense that they react with one another during conventional densification processing that utilizes higher temperatures as an aid to overcoming non-wettability difficulties. As a result of such reactivity the finished composite may include new components or phases, the presence of which generally adversely affects the character of the composite product.

The prior art discloses densification of ceramic-metal composites by means of a number of techniques that include hot pressing, hot isostatic pressing (HIP) and explosive compaction. Thus, Schwarzkopf in U.S. Pat. No. 2,148,040 discloses a hot pressing process for densifying a ceramic-metal mixture involving heating the mixture to a presintering temperature that is defined as 10–15 percent below the melting temperature of the entire mixture. The resulting spongy, porous structure, preferably still hot, is then extruded through an orifice at 71.1–213.3 thousand pounds per square inch (kpsi) pressure (489.0–1469.6 MPa). The pressure increase causes the lower melting point metal component to start to flow thus filling the interstices between the ceramic particles.

A difficulty with the composites produced by Schwarzkopf was that they were not reliably fully dense or uniform because of inadequate temperature control. Also, the extrusion pressing step severly limited the types of composites that could be produced to simple shapes.

A complexly shaped ceramic-metal composite is produced by making a homogeneous slurry mixture of the component powders which slurry is then, for example, cast upon a mold of desired complexity and dewatered to form a green body or compact. The compact is heated to a high temperature to produce a final densified compact but substantially below 100 percent of theoretical density. It was quickly recognized that the application of high pressure would aid in further compaction. It was also recognized that conventionally available pressures of up to a few thousand psi were inadequate to achieve full density for a number of ceramic-metal compacts.

Interest, therefore, turned to explosive compaction processes in which pressures could be applied to ceramic-metal composites on the order of many thousands of pounds per square inch applied in milliseconds. Thus, McKenna et al. in U.S. Pat. No. 2,648,125 surrounds a ceramic-metal compact with a body of liquid and subjects the body of liquid to explosive pressure that isostatically applies 50–60 kpsi pressure to the compact. McKenna notes that it is desirable that the pressure not be developed too rapidly and that maximum pressure is best achieved within 25 to 50 milliseconds. Brite et al, in U.S. Pat. No. 3,276,867 discloses a process for densifying a mixture of powdered uranium oxides or nitrides, etc. and a powdered metal such as tungsten, nickel, iron or the like. The process requires heating the mixture to a temperature that is below any reaction temperature between the powders followed by a high energy, high rate compaction, exerting pressures of 250–400 kpsi over 2–6 milliseconds. Zernow et al. in U.S. Pat. No. 3,157,498 employs an explosive technique in which the compact is subjected to short-time high compression which induces a very large adiabatic temperature increase that may be on the order of several thousand degrees K in the compact.

The explosive compaction processes were unsatisfactory for a number of reasons. Process temperatures utilized were difficult to control, often, as in Zernovw et al, resulting in such large increases that adverse phase formation occurred. Composites so processed were generally limited to small sizes and the extreme pressures often caused composite cracking. The industry therefore turned to elevated temperature pressing at somewhat lower pressures, as a means of attaining more uniformily formed composites.

Lichti et al. in U.S. Pat. No. 4,539,175 describes compacting powder material such as a ceramic-metal body by heating the body to 926° C.–2204° C. and isostatically pressing at 20–120 kpsi.

In forming void-free metal parts from metal powders Nyce in U.S. Pat. No. 4,591,482 initially heats a metal compact to a temperature 10–20 percent lower than sintering temperature. A pressure of 1–2 kpsi is applied to densify the compact and is said to cause a temperature spike that forms small amounts of liquid in the compact that assists in collapsing remaining voids to achieve a substantially fully dense finished part. The temperature spike is described as bringing the compact back to the sinter temperature but only for 5–10 minutes in order to avoid significant grain growth which leads to weakening of the product.

These relatively lower pressure processes tend to employ relatively high temperatures that, in combination with duration of the process, produce multiple phases in incompatible, that is, reactive ceramic and metal systems. As noted earlier, the presence of these phases can be detrimental to finished products qualities.

Recent work focuses more directly upon the mechanisms thought to be involved in the compaction process. Thus, Halverson et al. in U.S. Pat. No. 4,605,440 teaches that in many ceramic-metal systems, densification is improved where a composite is subjected to sufficient temperature such that a liquid metal phase is formed that has a low contact angle of the liquid phase on the solid ceramic phase. This condition is termed wetting and satisfies the capillarity thermodynamic criterion for the system. Halverson describes fully dense boron carbide aluminum composites that are prepared by sintering at a temperature of 1180° C.-1200° C. where wetting of the ceramic component via the aluminum metal component occurs. However, the products produced by Halverson include a number of ceramic phases that differ from the starting materials, including $AlB_2$, $Al_4BC$, $AlB_{12}C_2$, $AlB_{12}$ and $Al_4C_3$, that adversely affect the mechanical properties of the composite product. These undesirable ceramic phases develop because of the incompatibility between boron carbide and aluminum at the sintering temperature and appear because the reaction rates of aluminum with $B_4C$ are higher than the rate of the densification process.

Pyzik et al. in U.S. Pat. No. 4,702,770 focuses upon the reactiveness or "incompatibility" characteristics of many ceramic-metal systems at elevated temperatures, particularly those temperatures related to achieving wettability. Pyzik produces composites that consist chiefly of boron carbide, aluminum and minor amounts of other ceramic phases, generally avoiding the multiphase results of Halverson. In Pyzik's process, the kinetics of the chemical reaction between $B_4C$ and Al are reduced by sintering the $B_4C$ ceramic component at above 2100° C. For example, a porous green body of the $B_4C$ is formed, sintered at 2100° C. and then infiltrated with aluminum at a temperature above 1150° C. The method permits some control over the rate of reaction, but does not avoid formation of all undesirable ceramic phases. Additionally, if the metal used is an alloy, the high temperature required for infiltration typically completely changes the composition of the metal found in the composite, e.g., an aluminum alloy of Al, Zn, Mg would change composition at an infiltration temperature of greater than 900°-1000° C. through evaporative losses of Zn and Mg.

In summary, the technologies of densification of ceramic-metal composites by pressing techniques, particularly for chemically incompatible and non-wetting ceramic-metal systems, fail to reliably produce fully densified composites. Predictability of product characteristics is low where the pressing techniques involve higher temperatures. The failure in the art is due to a lack of understanding of how the results achieved in the densification process are influenced by interaction between the wettability characteristics and the incompatibility characteristics of the ceramic and metal components sought to be densified. The more recent work of Halverson et al. teaches the necessity for achieving wetting of ceramic by metal by employing high temperature processing. However, the results achieved at these high temperatures due to chemical reaction between the incompatible components generally causes fast depletion of the metal and often formation of undesirable new phases. The Pyzik et al. process achieves wetting while reducing formation of multiple ceramic phases but requires separate processing steps at high temperatures for the ceramic phase.

SUMMARY OF THE INVENTION

The present invention solves the difficulties of the prior art teachings by recognizing the criticality of: (1) heating a ceramic-metal mixture or compact to a temperature that produces a liquid metal phase: (2) applying sufficiently high external pressure to the system such that, in combination with heating, liquid metal is forced between ceramic grains while avoiding temperatures that enhance undesirable ceramic phase formation, and; (3) using a sufficient amount of metal for each particular ceramic-metal system such that voids between ceramic grains are filled.

The present invention provides a method for forming dense ceramic-metal composites that achieve a final composition that is substantially similar to the starting chemistry of the ceramic-metal mixture and is further characterized by microstructures wherein the size of the ceramic grains is similar or identical to the starting powder. The composites include a continuous or discontinuous metal phase. The method of the invention produces dense, substantially void-free composites that are generally more than 95 percent of the theoretical density of the starting mixture. In contrast to the prior art, processing is conducted at conditions wherein liquid metal flows into interstices between ceramic grains but does not subject the compact to such conditions whereby incompatibility between the ceramic and metal results in unwanted ceramic phases that adversely affect finished product quality. Where ceramic phases are desired, the method of the invention permits controlling the type of phases formed and their kinetics. The composites of the invention, having a chemistry close to the starting composition, can then be elevated to higher temperatures to form desired ceramic phases or treated at lower temperatures to achieve other metallurgical characteristics.

The method of the invention of densifying a ceramic and metal mixture or composite includes first forming a substantially homogeneous mixture of one or more ceramic materials and one or more metal materials. Typically, the mixture is formed into greenware by conventional casting or pressing techniques. The mixture or compact is heated to a first temperature that approximates but is below that temperature at which the metal begins to flow. Such temperature may be higher than the pure metal melting temperature depending upon the degree of oxidation of the metal powder utilized. The method then requires pressing the mixture or compact at such pressure that compaction and densification of the mixture or compact occurs. The pressing step induces a second temperature in the compact wherein the second temperature equals or exceeds the temperature at which the metal components melt and flow such that the mixture is further compacted and densified, achieving substantially void-free compacts that are at least near 100 percent of theoretical density with respect to the initial mixture. The second temperature, in absolute value and duration, remains below those conditions which would cause a significant undesired reaction between the metals and ceramics of the mixture.

The pressing pressure is applied at such a high rate of increase and for such a short duration that the temperature profile of the compact includes a spike increase of about 10° C.–200° C. that is sufficient to improve densification but minimizes exposure of the mixture to temperature conditions at which significant adverse reaction between the metal and ceramic occurs.

The pressing step requires at least about 60 kpsi (413.4 MPa), applied at a rate of at least about 5–250 kpsi per second (34–1750 MPa per second). A practical upper pressure limit is about 250 kpsi (1750 MPa). However, where the first temperature has been properly selected, pressures as high as 700 kpsi may be used. The method of the invention requires careful selection of the initial heating temperature of the compact in order to insure that the induced temperature by the pressing step does not exceed temperatures where adverse reactions may occur between the ceramic and metal components.

The induced second temperature is chosen such that no adverse reactions between the ceramic and metal occur. The increase in temperature for a given composition and pressure may be calculated utilizing thermodynamic and physical characteristics of the components and system. This calculation establishes the first temperature achieved by the initial heating step.

The pressing step may utilize any means which applies pressure to the ceramic-metal composite compact. A preferred method requires isostatic pressing. A greenware compact, typically at 50–70 percent of theoretical density, is encapsulated in a non-reactive pressure transmitting fluid or fluidizable medium that is contained such that applying a pressure to the medium applies pressure to the compact isostatically, thereby densifying the compact. The compact can be prepared using methods known in the art for greenware preparation including, for example, cold isostatic pressing, which is preferred. The method of the invention may include a first, compact forming, pressing step wherein the compact is encapsulated in the pressure transmitting medium and pressed at less than 60 kpsi such that the partially densified compact has a density of at least about 50 percent by weight of theoretical density. The compact then remains encapsulated in the pressure transmitting medium during the subsequent heating step and the pressing step wherein the second temperature is quasiadiabatically induced in the compact. Following the pressing step, the pressure is released and the compact cools before significant reaction between the metals and ceramics occurs. The method of the invention is particularly useful in producing fully densified compacts from ceramics and metals that are chemically incompatible or reactive and are non-wetting below reactive temperatures.

The invention includes densified ceramic-metal compositions that comprise a ceramic in an amount of at least about 50 percent by volume of the composition wherein the ceramic is $B_4C$, SiC, $SiB_6$, $SiB_4$, $AlB_2$, $AlB_{12}$, $AlB_{12}C_2$, $Al_4BC$, TiB, $TiB_2$, TiC, $Al_2O_3$, MgO, mullite, $ZrO_2$, $MgSiO_3$, $Mg_2SiO_4$, $MgAl_2O_4$, $Mg_2Al_2Si_5O_{18}$, TiN, WC, AlN, $Si_3N_4$ or mixtures thereof. The composition includes a metal such as Al, Mg, Ti, Fe, Ni, Co, Mn, Cu, Si or their alloys.

A preferred densified ceramic and metal composition comprises a silicon boride in an amount of 50–80 percent by volume of the composition wherein the silicon boride is $SiB_4$, $SiB_6$, $SiB_{14}$, SiBx or their mixtures and a metal such as Al, Cu, Fe, Co, Ni or their alloys. A most preferred composition of silicon boride includes $SiB_4$ and $SiB_6$ in an amount of 60–70 volume percent of the composition. Preferred metals include aluminum and copper or an aluminum alloy. These ceramic-metal composites are characterized by compositions and ceramic grain size that are substantially similar to the initial homogeneous mixture of the ceramic and metal components.

Of particular interest in the invention are cermets made of highly chemically incompatible and non-wetting ceramics and metals such as $B_4C$-Al and $B_4C$-Al alloy materials. Other such systems include SiC, $SiB_6$ and $SiB_4$ with aluminum; $B_4C$ with Mg, Fe: SiC with Cu. Particularly interesting non-wetting systems include $AlB_2$, $AlB_{12}$, $TiB_2$, AlN, $Si_3N_4$ or $Al_2O_3$ with aluminum.

DETAILED DESCRIPTION OF THE INVENTION

Figure 1:
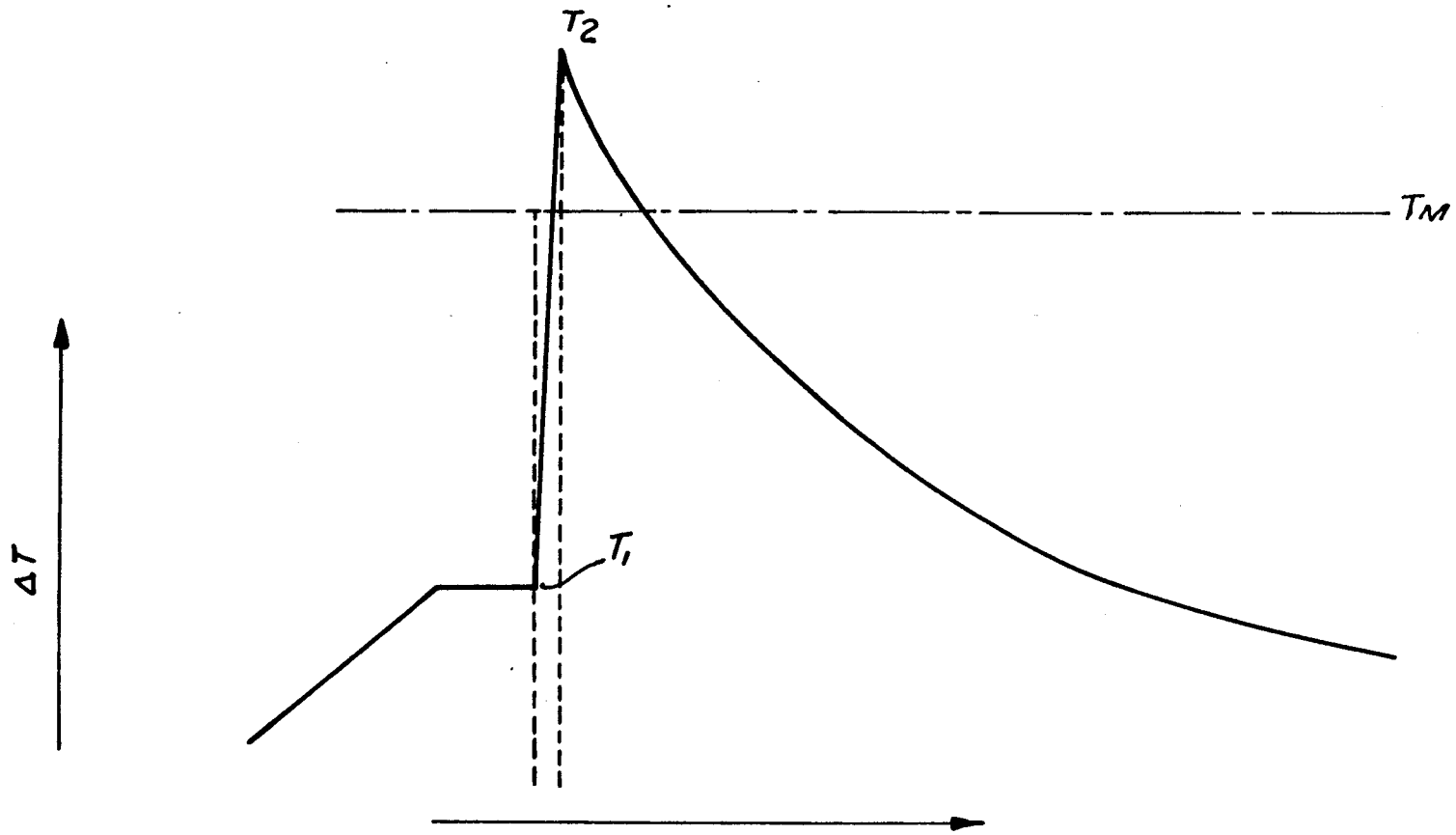
FIG. 1 shows an induced temperature that exceeds the melting temperature, $T_M$, of a metal phase, in accord with the method of the invention.

A ceramic-metal system to be densified, applying classical models of liquid phase sintering, must satisfy thermodynamic criteria of capillarity and compatibility. Densification takes place in three stages: (1) rearrangement; (2) solution-reprecipitation; and (3) solid phase sintering. Very often, however, ceramic-metal systems deviate from this model and are characterized by mutual insolubility and/or strong chemical reactivity. Where both constituents are thermodynamically compatible, i.e., non-reactive, the main densification mechanism is phase rearrangement caused by capillary forces. Where the solid and liquid are in a state of thermodynamic incompatibility, the ceramic and metal components react to complete depletion of one of them. For many ceramic-metal systems, the kinetics of the chemical reaction are faster than the kinetics of densification. As a result, difficulties have been encountered in developing many potential ceramic-metal composites. For example, as the reaction proceeds, newly formed ceramic phases bridge ceramic grains such that further rearrangement becomes impossible.

The rate of chemical reaction for many ceramic-metal systems may be reduced by processing at lower temperatures. However, as a consequence, wetting may then be very difficult to achieve, which explains the general lack of success of the prior art lower temperature pressing processes in achieving 100 percent densified composites.

Drastically higher pressures often employed as described in the prior art noted above also did not succeed in fully densifying ceramic-metal composites. When a ceramic-metal mixture or composite of two or more constituents or phases is dynamically compacted and only one phase, such as a metal phase is deformable, the density change of the composite observed in response to pressure is due only to the deforming phase. If a major constituent present, such a ceramic phase, is substantially non-deformable, applied pressure causes densification through rearrangement to a point where a rigid skeleton forms and then rearrangement stops. The rigid skeleton formed by particles of hard ceramics, makes deformation of any soft metal located in the ceramic interstices impossible and the system has lost its driving force to shrink further. Further densification will not take place even where a deformable metal phase is present and high pressures are exerted upon the compact, unless the pressures exceed those at which ceramic grains fragment.

Further densification of ceramic-metal systems will occur, however, in accord with the method of the invention, where there is a significant liquid metal phase present in the compact. While the prior art densification processes rely upon pressure forces alone or capillary forces alone or some combination of the two forces that does not account for their interaction, it is a key element of the present invention to replace or supplement the internal capillary forces of a given, particularly non-wetting, system with a carefully selected and interrelated pressure-temperature regime that first, creates a substantial liquid metal phase and, secondly, pushes the liquid metal into ceramic grain interstices to achieve fully dense products. Careful selection of the regime insures that unwanted grain growth and multiple ceramic phases are not generated. Thus, densification of the ceramic-metal mixture takes place through plastic deformation of ceramic and through rearrangement of the ceramic grains. Final rearrangement of the ceramic grains is controlled by the behavior of the liquid metal phase, which in turn is affected by such factors as wettability, solid in liquid solubility and kinetics of chemical reactions.

Liquid appearance in the composite system drastically changes ceramic-metal densification behavior under applied pressure. For example, it was discovered through compaction experiments with $B_4C$-30 volume percent Al composites that densities ranging between 73 and 99 percent of theoretical density are possible where there is absence or presence, respectively, of a liquid metal phase in the composite during compaction. The difference in results is thought to be due to the liquid metal phase causing extensive surface lubrication of the ceramic grains, wherein the grains slip by one another in the densification process forming a more compact, more dense product. The extend of this effect depends upon interaction between solid ceramic particles and liquid metal. Even though compaction may last only a few seconds, liquid may remain in contact with the ceramic particles much longer depending upon the size of the compact, the processing method employed, compaction temperature and other system parameters.

Thus, a proposed densification mechanism applicable to the method of the invention is: (1) formation of a liquid metal phase: (2) collapse of the ceramic phase structure under applied load; and (3) injection of molten metal between ceramic grains. An important factor in achieving 100 percent, void-free densification is also the presence of a sufficient amount of metal to completely fill all the voids and interstices of the ceramic material. The amount of metal required for densification depends upon specific system characteristics and must be determined for each system.

In the method of the invention a most essential part of the invention is that the metal phase of the ceramic-metal mixture or composite must form a melt which, under the influence of rapidly applied high pressure, is injected between the ceramic grains, causing the ceramic structure to collapse and densify. A second critical component of the invention is that the temperature increase of the composite during densification is limited both in absolute value and duration such that no significant chemical reaction occurs between the ceramic and metal materials present. By "no significant reaction" it is meant that any newly formed phases are not present in an amount sufficient to bridge ceramic grains making their further rearrangement impossible or to undesirably affect product characteristics or to deplete liquid metal such that full, substantially void-free density cannot be achieved. The method of the invention requires that the limited temperature increase is induced by a rapid application of high pressure for a few seconds followed by release of pressure and cooling of the finished, fully densified composite.

Referring to FIG. 1, the method requires first heating the ceramic-metal mixture or compact to a temperature $T_1$ that approximates but is below the temperature $T_M$ at which the metals present in the system begin to melt and flow. The mixture or compact is then subjected to a pressing step wherein the application of high pressure causes a change in volume of the composite that results in an quasiadiabatic temperature increase $\Delta T$ to temperature $T_2$ that exceeds the temperature $T_M$. The formation of the liquid metal phase acts as a lubricant that aids in the final densification. The temperature $T_2$ is held only momentarily and the composite then is cooled. Preferably, the area in the triangle above $T_M$ is minimized to avoid the opportunity of adverse reactions between the metal and ceramic phases which is particularly important for chemically incompatible systems. It is also an advantage to minimize the duration of the temperature spike for non-wetting ceramic-metal systems in order to minimize liquid migration after densification.

Determination of the temperature parameters $T_1$, $T_2$, $\Delta T$ and $T_M$ of the method of the invention requires care, particularly where incompatible ceramic-metal composites are to be formed. Of initial concern is the determination of $T_2$, the peak temperature of the process. $T_2$ is selected such that it does not reach temperatures where significant adverse reactions between ceramic and metal components occurs. Selection of $T_2$ is preferably based upon knowledge of the reactivity of the particular ceramic-metal system. Such information is obtainable from the literature or by employing techniques such as high temperature X-ray diffraction or differential thermal analysis (DTA).

Figure 2:
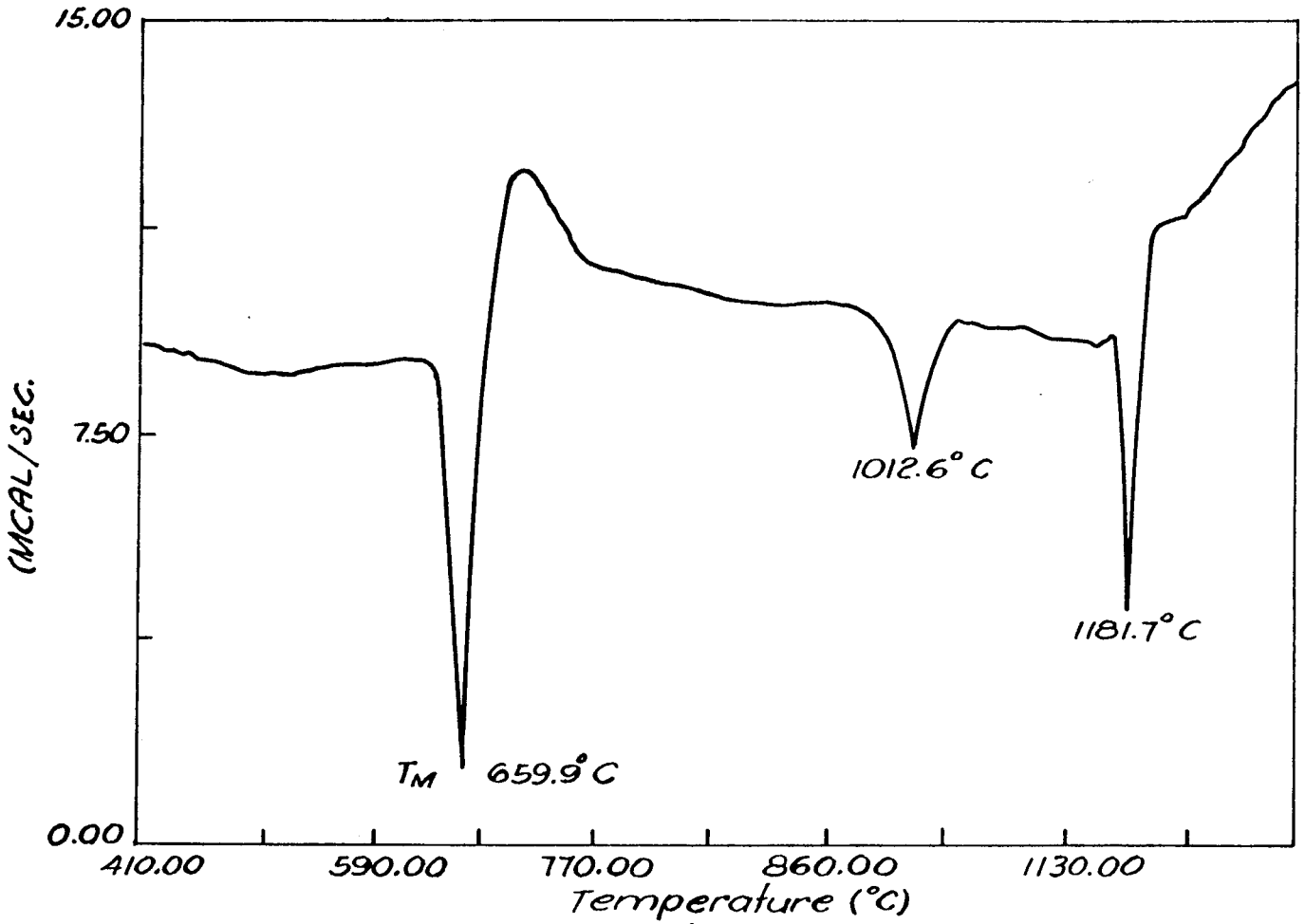
FIG. 2 is a Differential Thermal Analysis of the $B_4C$-Al system.

Referring to FIG. 2, a DTA for $B_4C$-30 volume percent Al is shown. The DTA shows that a strong exothermic reaction takes place at about 700° C. System densification is known to be slower than the kinetics of the chemical reactions between ceramic and metal. If held at 700° C., up to 3 different ceramic phases will form that are detrimental to finished product quality of the boron carbide ceramic. It is also well-known the $B_4C$-Al system is a non-wetting system below 1150° C. Thus, to achieve densification at temperatures below wetting temperatures the method of the invention employs high pressure to assist capillary forces in forcing the metal component into the interstices between the ceramic grains. Based upon an examination of FIG. 2, one notes a $T_M$ of about 660° C. and a first reaction at about 700° C. Consideration of these factors leads to selection of $T_2$ at less than 700° C. in order to avoid forming undesirable ceramic phases. It is noted that the boron carbide-aluminum system is extremely difficult to process by conventional methods and that densification of this system by the method of the invention demonstrates that other systems may also be densified.

Having determined and selected the peak temperature $T_2$ for the system it is now possible to calculate the increase in the temperature $\Delta T$ for a given system and pressure and, hence, determine the initial heating temperature $T_1$. The determination of $\Delta T$ utilizes a model based on the fact that, in order to change the volume of a compact under pressure, work has to be done in the system. As contemplated herein the system approaches an adiabatic process or is "quasiadiabatic" since there may be minor heat losses, depending upon the particulars of the system.

In such a quasiadiabatic system, work (W) performed in compaction may be defined by the expression:

$$W = p(V_f - V_o)$$

where:

p is applied pressure $V_f$ is composite volume after compaction $V_o$ is composite volume before compaction.

The temperature of the ceramic-metal system increases due to the work expended upon two components, plastic and elastic deformation of the system. The total temperature increase $\Delta T$ is the sum of $\Delta T_E$ and $\Delta T_P$. $\Delta T_E$, due to elastic deformation, can be calculated from the following equation:

$$\Delta T_E = \frac{3a\,p\,T_1}{Q_T\,C_o}$$

where:

a is the linear coefficient of thermal expansion for the ceramic/metal system p is applied pressure $T_1$ is initial heating temperature $Q_T$ is theoretical density of the ceramic/metal system $C_o$ is the heat capacity of the ceramic/metal system.

Assuming quasiadiabatic behavior of the composite-pressing system, wherein the composite is typically embedded in a glass pressure-transmitting medium, all work done on the system goes into heat. Then, temperature increase due to a plastic deformation, $\Delta T_P$, can be described by the following equation:

$$\Delta T_P = \frac{p\,(1/Q_o - 1/Q_f)C_o(T_m - T_1) - L_m W_m}{C_o'}$$

where:

p is applied pressure, $Q_o$ is green density, $Q_f$ is final density, $C_o$ is heat capacity of the ceramic/metal system, $T_m$ is melting temperature of the metal, $T_1$ is initial heating temperature of the system, $L_m$ is latent heat of the metal, $W_m$ is weight percent of the metal, and $C_o'$ is heat capacity of the composite wherein metal is molten.

Figure 3:
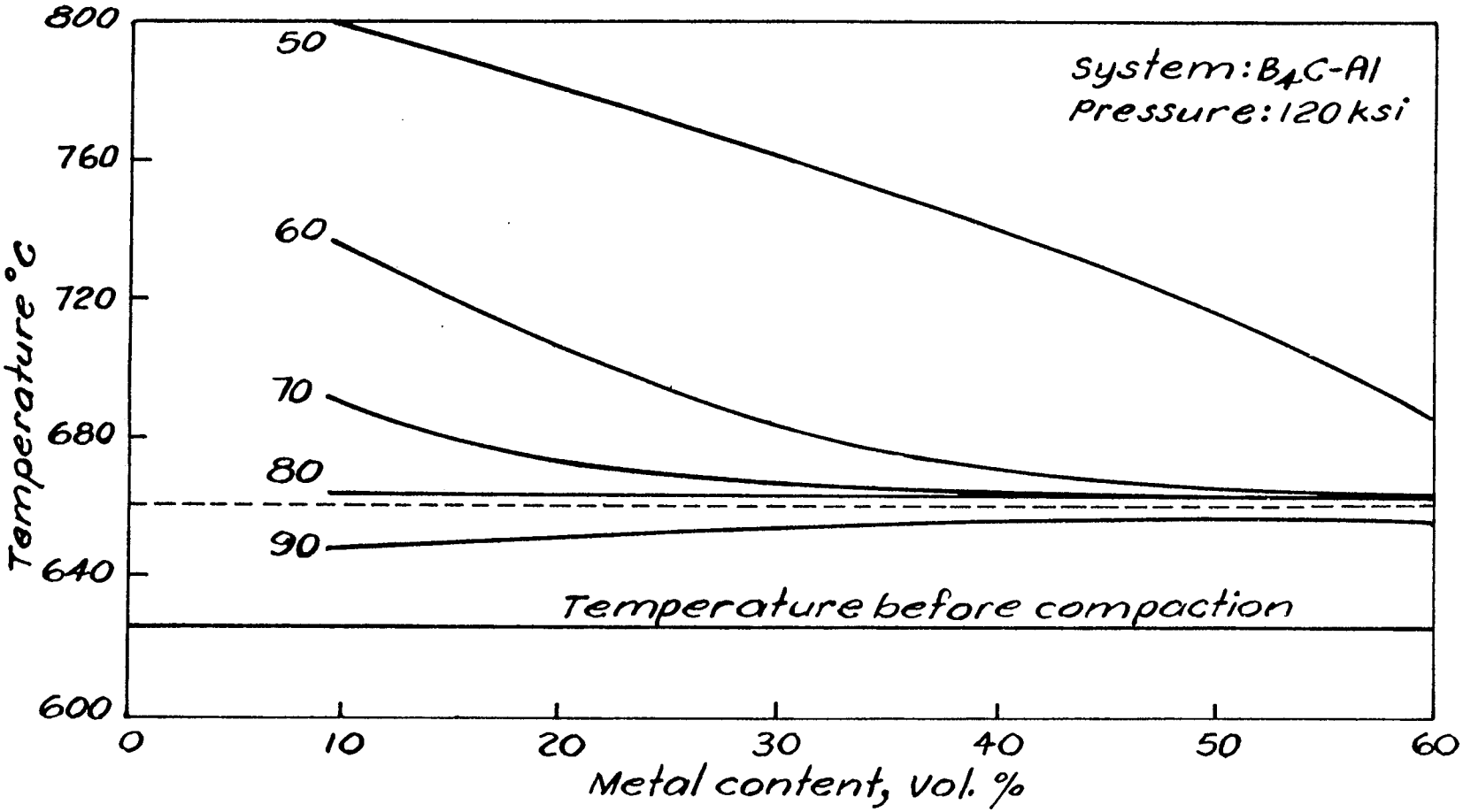
FIG. 3 shows the effect of compact composition and greenware density on pressing temperature increase for the $B_4C$-Al system.

$\Delta T$ is affected by a number of system characteristics that must be taken into account in estimating $\Delta T$. For example, FIG. 3 shows final temperature $T_2$ plotted against metal content for ceramic-metal compacts of different initial or green densities, ranging between 50 and 90 percent of theoretical density. $T_1$ in this $B_4C$-Al example is 625° C. The curves suggest that the lower the metal content and the lower the green density, the higher will be the temperature increase. The calculations employed in generating FIG. 3 assume that the final density of the system is equal to the theoretical density.

Figure 4:
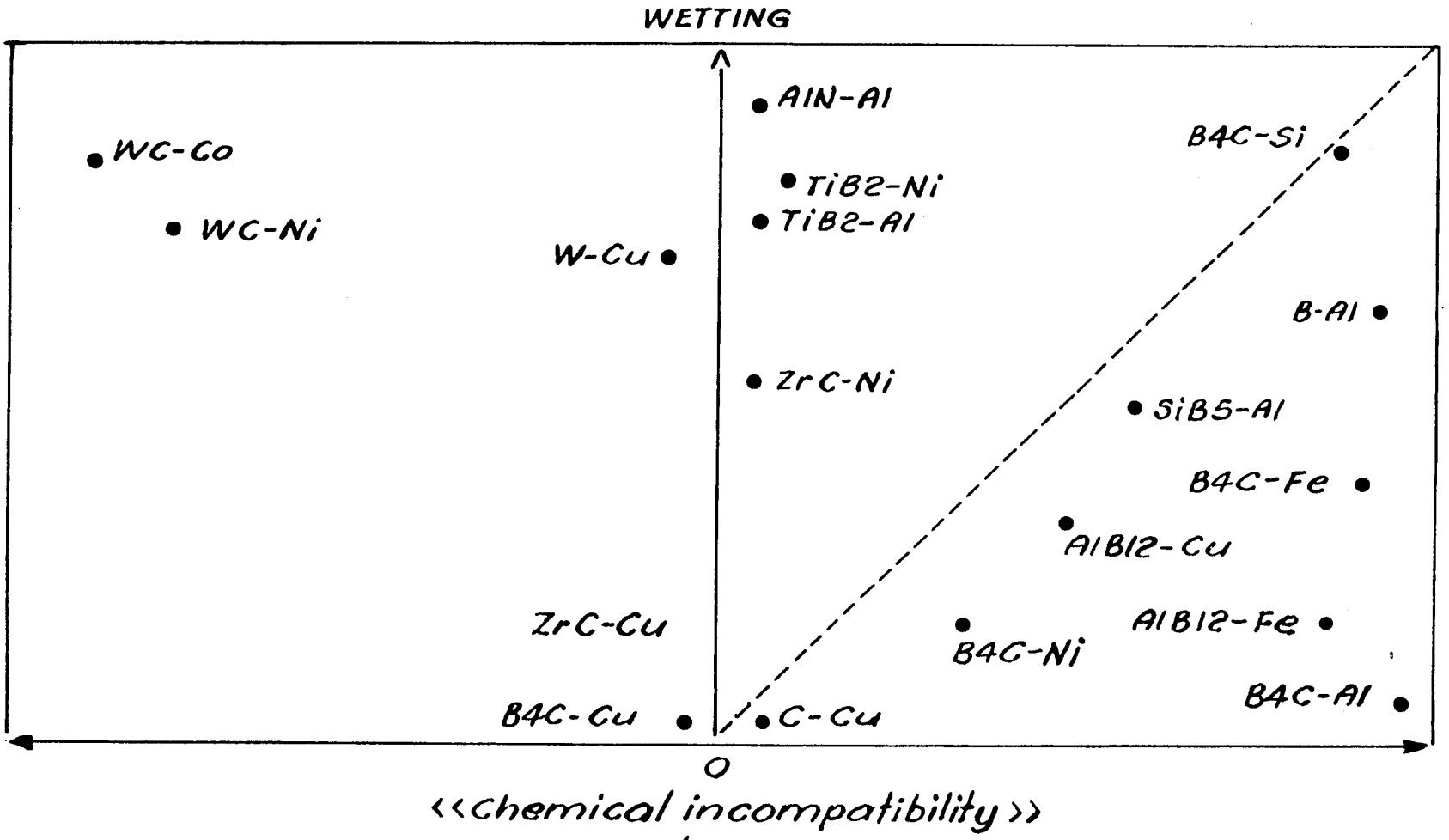
FIG. 4 is a diagram useful for determining the amount of metal content necessary for densification of a ceramic-metal compact.

It is impossible to densify a $B_4C$-Al system, or any other ceramic-metal system, unless there is a sufficient amount of metal present. Establishing the temperature parameters for the method of the invention thus also requires determination of the amount of metal required for full densification. Assuming that sufficient pressure is available, that the ceramic phase does not deform significantly and that a sufficient liquid phase appears in the system, it is possible to predict composite behavior during compaction and approximate the amount of metal required for full densification. Generally, the determination requires a knowledge of the wettability of the metal-ceramic system, the degree of compatibility between the components and the ability of the ceramic phase to deform. Wettability can be determined by measuring the actual contact angle of the liquid phase metal on the solid ceramic phase, as taught by Halverson et al, cited above. Evidence of compatibility of particular ceramic metal systems is generally available in the literature. From these elements a processing map or diagram can be established for densification of ceramic-metal composites. Referring to FIG. 4 such a map is presented. At the zero point of the diagram, ceramic-metal mixtures are characterized by non-wetting conditions (contact angles greater than 90° C.) and by chemical compatibility, permitting a prolonged contact between phases without chemical reactions occurring. $B_4C$/Cu or C/Cu are typical examples, characterized by contact angles greater than 90° over a wide temperature range.

Moving up on the diagram, still in the region of the vertical or y.axis, ceramic-metal systems with improved wetting (as a function of temperature) but negligible solubility, e.g., $TiB_2$-Ni, $TiB_2$/Al and $AlB_{12}$-Al, are indicated. In the direct neighborhood of the zero coordinates, obtaining highly consolidated materials is very difficult. As a result, large amounts of metal are required, on the order of 40–50 volume percent of the composition.

Movement along the horizontal or x-axis in either right- or lefthand directions indicates changing solubility of solid ceramic in the liquid metal. The fundamental difference between the left and right halves of the diagram is the composition of the reaction products that form. In systems located on the lefthand portion of the diagram, the metal dissolves ceramic. However, precipitating phases have similar or identical chemistry to the starting composition. The amount of liquid present depends on the solubility limit and can exceed the amount of the introduced metal by many times. In systems appearing on the righthand portion of the diagram, the formation of binary and ternary phases of new chemical compositions takes place. The amount of liquid is always lower than the amount of metal introduced and in extreme cases complete liquid depletion can take place.

The closer the location of the ceramic-metal system to the upper lefthand corner of FIG. 4, the easier it is to obtain high density with a small quantity of metal. For example, WC/Co, WC/Fe or TiC/Ni-Mo can be fully consolidated with 2–10 percent of metal. Those compositions appearing higher on the y-axis generally require 20–30 volume percent of metal in order to attain full density. The advantage of this type of chemical compatible ceramic-metal system is that wetting is possible to achieve without significant change in material composition and precise determination of the heating temperature $T_1$ is not as critical as in the case of chemically incompatible systems.

The closer the ceramic-metal composite is situated to the bottom righthand corner of FIG. 4, the more difficult it is to obtain highly densified materials. This is especially true for systems containing more than 60 volume percent of a ceramic phase. Therefore, many of these composites have never been obtained heretofore. Lack of wetting combined with fast chemical reactions create an ideal situation for the application of the method of the present invention. The method of the invention can be used to consolidate all types of ceramic-metal compositions to form composites or cermets. However, its advantage over other techniques is best illustrated by the consolidation of the ceramic-metal systems shown in the right-bottom triangle of FIG. 4.

Figure 5:
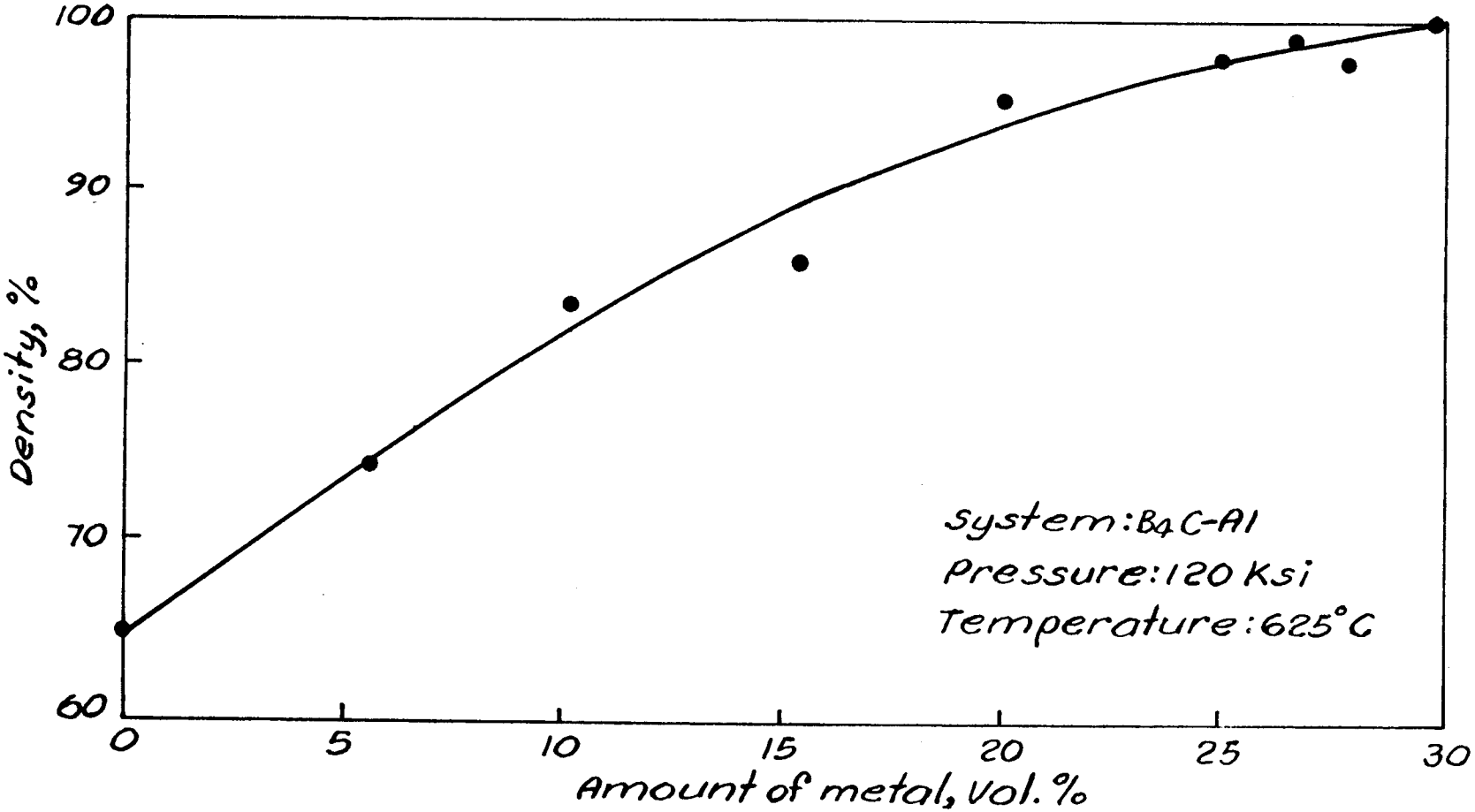
FIG. 5 is a graph showing the effect of the amount of metal content on densification of the $B_4C$-Al system.

FIG. 5 shows, for the non-wetting, incompatible systems of interest, here $B_4C$-Al, final compact density as a function of metal content. FIG. 5 indicates that at an initial temperature of 625° C. and the application of 120 kpsi, boron carbide ceramic alone can be densified to only 67 percent of theoretical density. By adding a molten aluminum metal phase, density increases to reach, at 30 volume percent, 99.2 percent of theoretical density.

Figure 6:
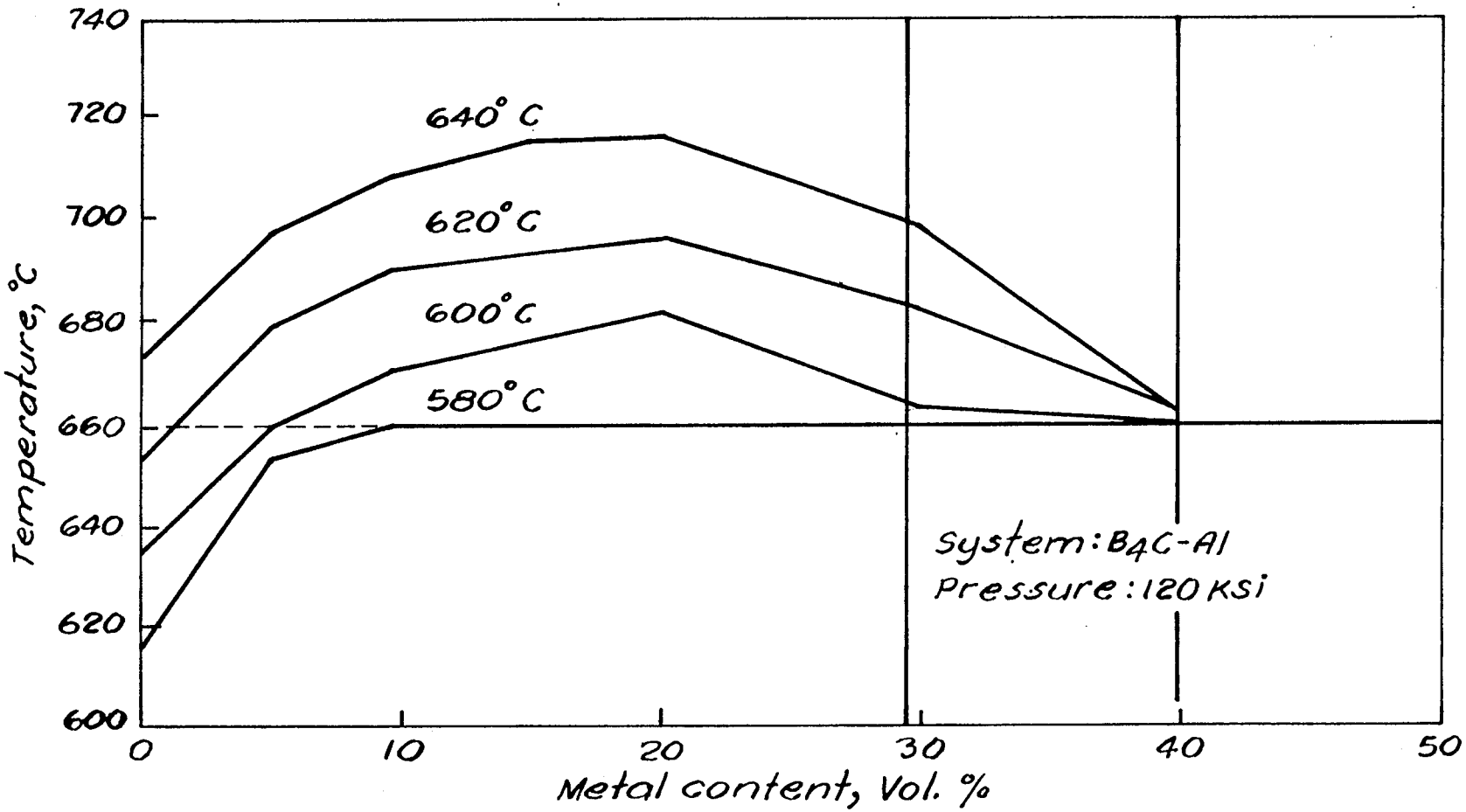
FIG. 6 shows the effect of metal content at initial heating temperatures on induced temperature, $T_2$, for the $B_4C$-Al system.

Referring to FIG. 6, calculations for the $B_4C$-Al system show the effect of metal content on the temperature $T_2$ attained, for various indicated initial heating temperatures. FIG. 6 shows that for the $B_4C$-Al system pressed at 120 kpsi, a maximum temperature peak is induced at about 20 percent by volume metal content. Below and above this metal content, the temperature increase is lower. It is important to note that even though the material is heated only to 625° C. initially, the compact experiences a temperature that exceeds the melting point of the metal. The same compaction conditions can result in differing $\Delta T$ and, as a result, the ceramic-metal system may have a liquid phase present or absent which in turn gives completely different microstructures and final densities. From a processing standpoint, presence of a liquid phase is required. For boron carbide-aluminum composites, the highest $\Delta T$ is at 20 percent of the metal. However, 30 percent metal is required in order to attain full density as shown in FIG. 5. By increasing the metal content or changing green density, as shown in FIG. 3, $\Delta T$ and $T_2$ can be controlled to stay above but close to the metal melting point.

The important mechanism of densification under pressure, i.e., plastic deformation, is not very effective for boron carbide-aluminum composites. At about 600° C. boron carbide is hard to deform and a large part of aluminum metal remains enclosed in cavities between boron carbide grains and does not experience any pressure. When the metal melts and liquid appears, the situation changes but factors such as wetting, solubility and rate of chemical reactions must be considered.

Solubility of boron carbide in liquid metal increases as a function of temperature. Wettability increases (i.e., contact angle decreases) which usually helps in grain packing because the liquid phase acts as a lubricant. However, it has been found that at 625° C., density of the composite is 99.2 percent of theoretical density while at 900° C. only 85 percent density is achieved. This is so because the $B_4C$-Al system is highly reactive. At higher temperature new phases are formed to such an extent that liquid metal is depleted. New phases bridge $B_4C$ grains creating a rigid skeleton and further rearrangement becomes impossible. At 660° C. solubility of $B_4C$ and Al is low and the system is substantially non-wettable (contact angle is greater than 90° C.) and plastic deformation of the ceramic does not take place. Therefore, one needs to use metal in an amount required to fill all existing voids. With good packing of boron carbide this amount of metal is substantially close to 30 percent.

Figure 7:
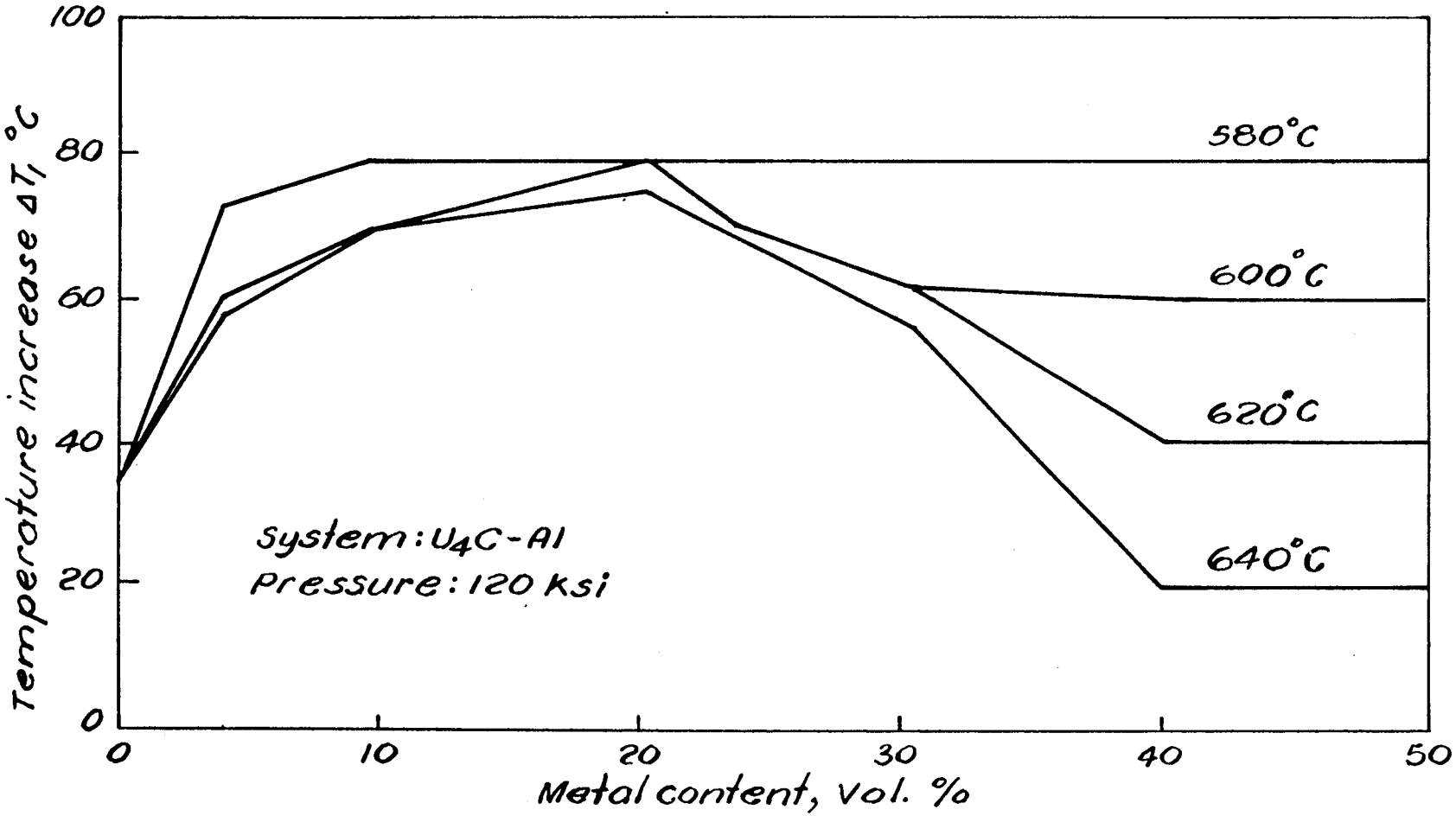
FIG. 7 depicts $\Delta T$ for the $B_4C$-Al system as a function of metal content and initial heating temperature.

Referring to FIG. 7, the temperature increase $\Delta T$, for the $B_4C$-Al system is shown as a function of metal content and a number of initial heating temperatures $T_1$, ranging between 580° C. to 640° C. The figure shows that the lower the initial heating temperature $T_1$, the less sensitive the system is to composition change. At 580° C. no practically usable adiabatic heating effect is attained. At 600° C. there is only a narrow range of metal content where high density materials can be achieved, i.e., at about 30 volume percent of metal. At 620° C. and 640° C., the potential composition range is wider, i.e., above 30 volume percent. The higher the amount of $B_4C$ desired in the composite, the narrower the processing range where the boron carbide-aluminum composite can be successfully compacted. However, as the initial heating temperature $T_1$ is increased, the longer the liquid phase will be in contact with ceramic and subject to undesirable phase formation. Thus, there is only very narrow processing range where the boron-aluminum composite can be successfully compacted.

Figure 8:
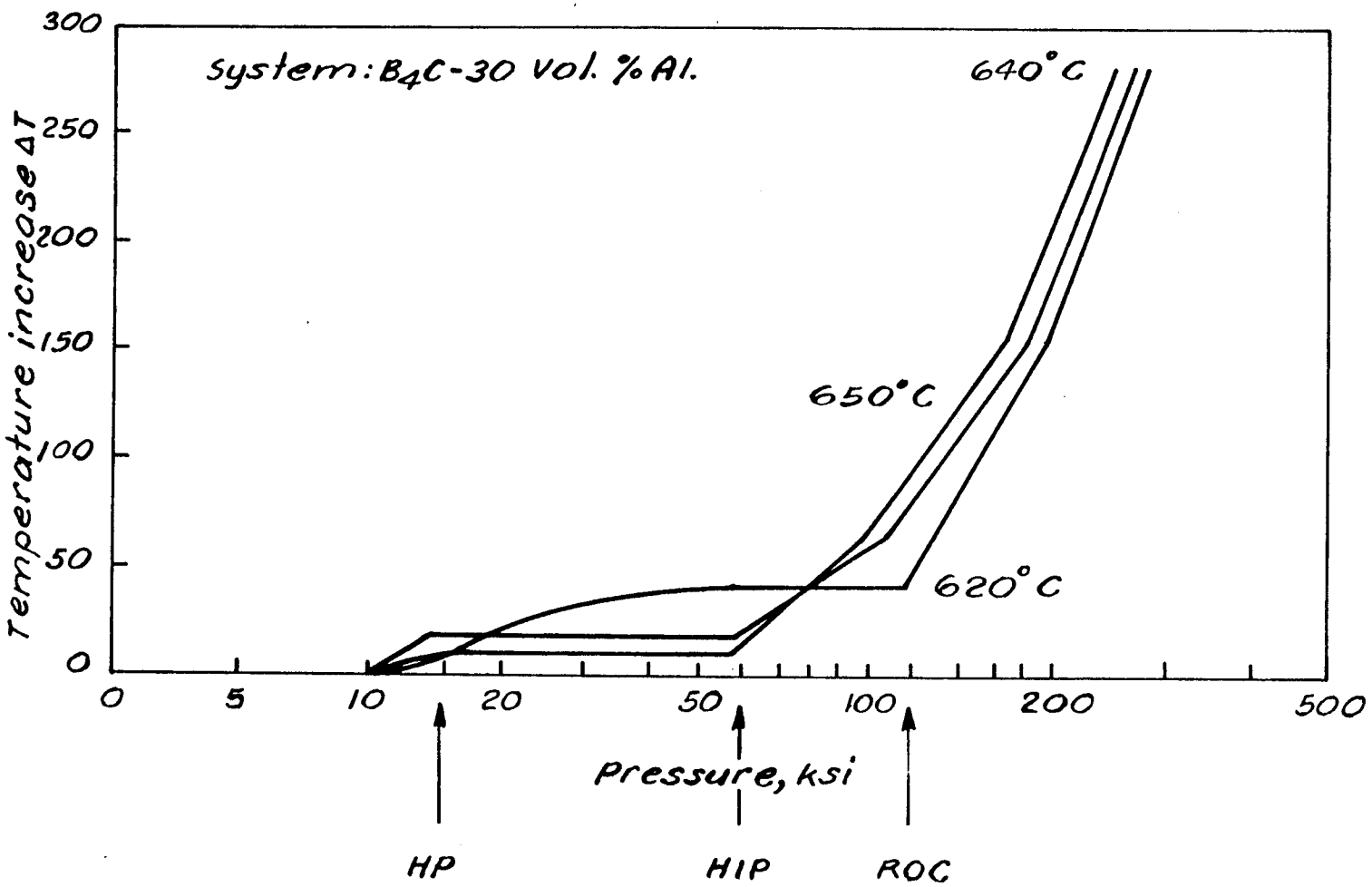
FIG. 8 shows $\Delta T$ as a function of pressing pressure for initial heating temperatures.

Referring to FIG. 8, the induced temperature increase $\Delta T$ is shown as a function of pressing pressure for curves indicating various initial heating temperatures, $T_1$. FIG. 8 shows that the quasiadiabatic compaction effect, i.e., the induced change in temperature from $T_1$ to $T_2$ leading to complete metal melting as a result of application of pressure, cannot be obtained at pressures lower than about 60 kpsi. By increasing applied pressure from 120 kpsi to 200 kpsi one can increase $\Delta T$ from 70° C. to 150° C. At 300 kpsi $\Delta T$ is as high as 280° C. Therefore, from a ceramic-metal processing standpoint, limiting pressure is a significant consideration in establishing the limits of the method of the invention.

In preparing the ceramic-metal mixtures for densification by means of the method of the invention, the ceramic and metal may be in the form of particles, platelets, whiskers or chopped fibers. The mixture should be mixed to a homogeneous composition in order to achieve a uniform microstructure in the finished composite. In general, the better the mixing, the less metal that must be used to achieve the same final density. Preferably, the ceramic and metal are in powder form that is first blended together by using colloidal mixing techniques, dry mixing or wet mixing. The blended mixture is then slip-cast and/or isostatically pressed to form a greenware that is a partially densified compact. The greenware is then heated to a temperature that is close to the metal melting point. The temperature to which material needs to be heated must be high enough to assure that after applying pressure the metal will form a maximum amount of liquid that is injected during pressurization between the grains causing densification and low enough to assure that the peak temperature attained is lower than the temperature at which extensive reaction takes place between the ceramic and metal phases. As noted above, the peak temperature $T_2$ for a given ceramic and metal system can be determined by using high temperature X-rays diffraction or differential scanning calorimetry techniques (as shown in FIG. 2).

When a reaction temperature for a given ceramic and metal system is very close to the metal melting temperature, i.e., within less than 50° C.-80° C., then the initial heating temperature must be below the temperature of first liquid appearance. Exact heating temperatures for given pressures can be calculated from thermodynamic pressure-volume-density data, as shown above, knowing the heat capacity of the ceramic, latent heat of the metal, material chemical composition, density of the greenware and heat capacity of the surrounding sample medium. When temperatures at which reaction between ceramic and metal phases takes place is higher than the metal melting point by more than 50° C.-80° C., the greenware can be heated at the metal melting point or above. The critical condition here is that if substantial liquid metal movement takes place, then uniformity of microstructure is lost.

Usually, fine metal particles are strongly oxidized on the surface. A layer of oxide provides protection from direct contact between ceramic and fresh metal surfaces and also prevents liquid flow. With such metals the initial heating temperature depends to some extent on the degree of metal oxidation. Typically, for a metal like aluminum, the temperature at which liquid flows for the oxidized material can exceed the pure metal melting temperature by 100° C.-250° C.

When the greenware compact has achieved a uniform temperature, pressure is applied to the compact. The pressing step requires a rapid application of pressure to 60-250 kpsi, applied at a rate of 5-250 kpsi/-second. Fresh liquid metal appears in the material and acts as a lubricant assisting in compaction of the ceramic particles. The particles rearrange and the rigid ceramic structure collapses. Densification is achieved in a matter of seconds. After the desired density is achieved, the composite material may be cooled. The time from applying pressure to metal solidification depends on the magnitude of the pressure and initial heating temperature employed. The intent of the method of the invention is to reduce to a minimum the time in which there is direct contact between the metal and ceramic at a elevated temperature.

The pressing step may employ any pressure technique that can apply the required high pressure and high rate of application to the greenware compact to be densified. A preferred method of pressing is the isostatic application of pressure that permits near net shape ceramic-metal composites of complex geometry. In one technique, ceramic-metal greenware is placed directly or indirectly, i.e., enclosed by protective foil or capsule, in a pressure-transmitting medium that is a gas, inorganic material, glass, ceramic, organic, plastic, oil or the like, wherein the medium is nonreactive or isolatable from the metal-ceramic composite.

The ceramic-metal powder mixture is typically formed into a greenware compact by means of conventional casting and the like techniques. The pressing step is preferably an isostatic means in which the greenbody composite is placed in an incompressible pressure transmitting medium and heated to a temperature slightly below the melting temperature of the metallic phase. The pressure transmitting medium and the greenbody contained therein are rapidly adiabatically compressed by the application of external forces to the pressure transmitting medium. The rate of application of the external forces should be sufficiently fast that quasiadiabatic conditions are achieved throughout the body of the greenware. As a result of the work performed by the external forces on the compact during its densification, from 50-60 percent to 100 percent dense material, the temperature of the compact rises above the melting temperature of the metal, the metal melts and under influence of the applied pressure penetrates into all small voids in the material completing densification of the compact to 100 percent of theoretical density. After pressing, the system is quickly cooled down and the liquid phase solidifies.

The method of the invention has distinct advantages over the conventional techniques. The ceramic-metal compact spends only a few seconds to a few minutes above the melting temperature of the metallic phase instead of several hours as required by the conventional techniques. This advantage permits densification of ceramic-metal systems that are characterized by incompatibility and fast reaction rates between the ceramic and metals. Application of high pressure utilized in this method makes it possible to process ceramic-metal systems that are characterized by poor wetting between the molten phase and the ceramic.

ILLUSTRATIVE EMBODIMENTS

The following examples demonstrate various aspects of the method and ceramic-metal components of the invention. The examples are for illustrative purposes only and are not intended as limiting.

EXAMPLE 1 - $B_4C$-Al COMPOSITES

Compositions of $B_4C$-Al at 100-65 volume percent $B_4C$ and 0-35 volume percent Al metal were made and densified. The $B_4C$ was 1500 grit, manufactured by ESK of West Germany. The boron carbide was characterized by a density of 2.52 g/cm$^3$, a thermal expansion coefficient of $4.5\times10^{-6}$ (°K)$^{-1}$, a heat capacity of 1.7 Joules/°K.g and an average particle size of 3 micrometers.

The aluminum powder, having an average particle size of 6 micrometers, was obtained from Alcoa and was characterized by a density of 2.7 gm/cm$^3$, a heat capacity $C_{(solid)}=0.9$ Joules/°K.g and $C_{(liquid)}=1.1$ Joules/°K.g, thermal expansion $\alpha=25\times10^{-6}$ (°K)$^{-1}$, a latent heat of 95 calories/g and a melting temperature of 660° C. (933 ° K.).

The ceramic and metal powders were mixed in ethanol forming a homogeneous slurry that was cast on a plaster mold in the conventional manner to form a greenware compact. The greenware was then dried. The density of the greenware was 55 percent of theoretical.

The $B_4C$-Al greenware was encapsulated in a rubber bag and pressed isostatically at 45 kpsi (308 MPa) forming a greenware that was partially densified to about 65 weight percent of theoretical density.

The partially densified $B_4C$-Al compact was wrapped in Al foil, embedded in a glass pressure transmitting medium, heated to 625° C. and dynamically pressed to 120 kpsi. Maximum pressure was reached in 3 seconds and held for 5 seconds. Table I reports metal percent by volume of the composition and percent of theoretical density achieved.

TABLE I

| Volume % $B_4C$ Ceramic | Volume % Al Metal | % Theoretical Density |
|---|---|---|
| 100 | 0 | 67 |
| 90 | 10 | 74 |
| 85 | 15 | 83 |
| 80 | 20 | 85 |
| 75 | 25 | 93 |
| 70 | 30 | 99 |
| 65 | 35 | 99 |

The data of Table I is shown graphically in FIG. 5. The effect of composition on peak temperature $T_2$ is shown in FIG. 6 for selected initial heating temperatures, $T_1$. Varying soaking temperature $T_1$ for the $B_4C$-Al system produced the results shown in Table II for the $B_CC$-30 volume percent Al system.

TABLE II

| Initial Heating or Soaking Temperature $T_1$ (°C.) | Percent of Theoretical Density |
|---|---|
| 580 | 72 |
| 600 | 73 |
| 610 | 94 |
| 620 | 98 |
| 625 | 99 |
| 635 | 99+ |

The results indicate that a drastic change in density occurs between 600° C. and 610° C. when the liquid phase appears in the material. Thus, to maximize amounts of molten metal present in the composite during compaction, a temperature above 620° C. needs to be employed during the initial heating step.

On the other hand to minimize the amount of formation of undesirable ceramic phases, the maximum temperature $T_2$, should be as close as possible to 660° C. $\Delta T$, and, as a result, maximum temperature $T_2$ can be controlled by changing green density of the composite and/or metal content. Several processing regions, leading to high density $B_4C$-Al cermets can be selected, as shown in Table III.

TABLE III

| | | | | |
|---|---|---|---|---|
| Composition Al % vol. | 30 | 30 | 40 | 40 |
| Pressure kpsi | 120 | 120 | 120 | 120 |
| Green Density, % | 60–70 | 65–70 | 60–70 | 50–60 |
| Temp. $T_1$, °C. | 625 | 635 | 640 | 625 |
| Final density, % | 99.0 | 99.2 | 99.1 | 99.3 |

By using higher soaking temperatures dense $B_4C$-Al composites can still be obtained. However, the composition of the compact will change because ceramic phases such as $AlB_2$ and $Al_4BC$ will form.

Example 1 illustrates that very reactive, non-wetting composites now exist. These composites are produced by the method of the present invention.

EXAMPLE 2 -$B_4C$-30 VOLUME PERCENT Al

The $B_4C$ and Al powders of Example 1 were utilized to produce a homogeneous 70 volume percent $B_4C$-30 volume percent Al mixture. The powders were mixed in ethanol to form a slurry. One percent by weight of an organic binder was added to the slurry. Mixing was continued for one hour followed by drying, crushing and sieving the powder mixture through a 60 mesh sieve. The homogeneous mixture was next cold-pressed at 5 kpsi and then isostatically pressed at 45 kpsi to form ½-inch diameter by ¼-inch thick disks. The pressed samples were heated at 450° C. for one hour in flowing argon to burn off the organic binder. The sample compacts were then wrapped in aluminum foil and placed in a castible ceramic open-shell purged with argon and filled with low viscosity lead-containing glass.

The system was heated with temperatures registered by thermocouples placed in the glass next to the sample compacts. Separate sample compacts were heated to 580° C., 625° C., 800° C., 1025° C. and 1180° C. soaking temperatures for an average heating time of 2 hours. After the soaking temperature stabilized the sample compacts were removed from the furnace and placed into a press where the sample composites were compacted to 120 kpsi. The time required to reach maximum pressure was about 3 seconds and the time to achieve maximum temperature was 3–10 seconds. After cooling, the samples were removed from the glass and sandblasted. Densities obtained were as follows:

TABLE IV

| Soaking Temperature, $T_1$ (°C.) | % Theoretical Density |
|---|---|
| 580 | 72.7 |
| 625 | 99.1 |
| 800 | 93.1 |
| 1025 | 85.1 |
| 1180 | 75.9 |

The data show that a sudden density increase occurs when the liquid phase appears in the system. After reaching maximum density, further increasing of the soaking temperature results in a density decrease. The density decrease is due to the fast kinetics of chemical reactions of the $B_4C$-Al system that leads to metal depletion and formation of new phases. These new phases bridge $B_4C$ grains making rearrangement of the grains under pressure impossible, thus resulting in lower density products.

EXAMPLE 3 -$C_4C$-30 VOLUME PERCENT Al AND PRIOR ART PROCESSES

Because the kinetics of chemical reactions between $B_4C$ and Al are so fast, the densification process has to be finished in a very short time. As a consequence, prior art techniques such as isostatic pressing do not result in high density composites. The method of the invention is the only technique that provides high density materials with chemistry and ceramic grain sizes close to the starting mixture characteristics.

TABLE V

| Technique Used | Initial Aluminum Content % by Volume | Final Aluminum Content % by Volume | Final Density Percent of Theoretical |
|---|---|---|---|
| sintering (700° C., 1 hr) | 30 | 5 | 78 |
| hot pressing (700° C., 0.5 hr) | 30 | 11 | 82 |
| hot isostatic pressing (700° C., 0.5 hr) | 30 | 11 | 84 |
| quasiadiabatic compaction (700° C. max. temp., 10 sec)① | 30 | 20 | 99.1 |

①Method and composites of the invention

Figure 9:
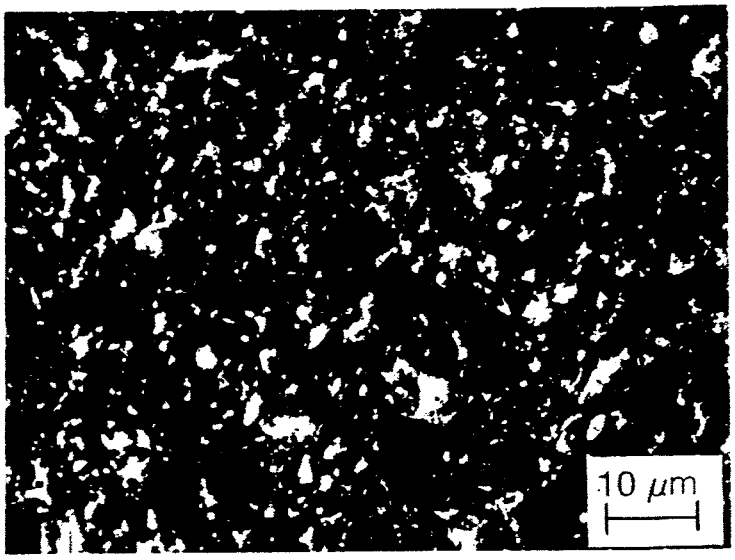
FIG. 9 is a scanning electron photomicrograph (SEM) of a $B_4C$-30 volume percent Al composite of the invention.

FIG. 9 is a scanning electron photomicrograph of the $B_4C$-30 volume percent composite of the invention.

EXAMPLE 4 - $B_4C$-Cu $B_4C$-Cu mixtures are characterized as extremely non-wetting with contact angles much higher than 90° . A composite was prepared by first coating the boron carbide particles with nickel. The nickel coating, having a higher melting temperature than copper, permitted achieving sufficiently high temperatures without adverse reactions where good wetting of the ceramic particles by copper could be achieved.

$B_4C$ powder of 15–25 micrometers was coated with nickel by the method of electro-less deposition. The deposition method required first cleaning the $B_4C$ material with HCL. $B_4C$ surfaces were then activated with a Pd catalyst. The activated $B_4C$ was mixed in a Ni bath at pH 9, resulting in complete Ni deposition on the $B_4C$ particles.

The Ni coated $B_4C$ was mixed with Cu and formed into a greenware that was then placed in a die containing a glass pressure-transmitting medium. The system was heated to 1025° C. and then dynamically compacted at 120 kpsi. A rapid temperature increase was induced in the compact sufficient to melt the copper phase whereby the copper penetrated the coated boron carbide grains forming a densified product. The nickel layer was retained on the boron carbide particles and overall density was substantially higher than conventional compositions. The results achieved are shown in Table VI.

TABLE VI

| Composition | % Initial Density | % Final Density |
|---|---|---|
| $B_4C$-16% Cu① | 60 | 74 |
| $B_4C$-8.6% Ni + 8% Cu | 60 | 94 |

①Not an example of the invention

The method of the invention permitted achievement of 94 percent of theoretical density with a metal content substantially lower than the 40 volume percent required by conventional hot isostatic pressing processes.

EXAMPLE 5 -$SiB_6$/$SiB_4$-Al

Compositions of $SiB_4$/$SiB_6$-Al at 100–50 volume percent $SiB_4$/$SiB_6$ and 0–50 volume percent of Al were made and densified. A powder having a SiB6/$SiB_4$ ratio of 86/14 is employed and was produced by Cerac Co. The silicon borides mixture was characterized by a density of 2.42 g/cm$^3$, an average particle size of 8 μm, and a heat capacity of 1.92 Joules/(°K).g at a temperature range of 600°–700° C.

The Al powder, having an average particle size of 6 μm was obtained from Alcoa and was characterized by a density 2.7 g/cm$^3$.

The ceramic and metal powders were mixed to form an ethanol slurry. A binder and dispersant was added to the slurry. The slurry was cast on a plaster mold, dried and isostatically pressed cold at 45 kpsi. Density of the greenware ranged between 57–63 percent of theoretical. After that composites were heated in flowing argon at 400° C. to remove the binder. The $SiB_6$/$SiB_4$-Al composites were wrapped in aluminum foil and placed in the glass fluid die. The die was heated to 625° C. and dynamically compacted at 120 kpsi.

Table VII reports metal percent by volume of the composition and percent of theoretical density achieved.

A summary of preferred conditions leading to producing dense, tough and strong silicon boride based cermets are as follows:

| | |
|---|---|
| Composition | 25–35 vol % Al |
| Mixing | colloidal in ethanol |
| Heating temp. $T_1$ | 625–635° C. |
| Pressure | 120 kpsi |
| Time at pressure | 5–10 seconds |
| Green density | 60–65% of theoretical |
| Maximum temp. $T_2$ | <700° C. |

Essentially fully dense composites were obtained with a metal content equal to or higher than 30 volume percent. The maximum temperature $T_2$ observed was for composites with 30 volume percent of metal. ΔT can be controlled by varying metal content, green density and the initial heating temperature. $T_1$. Examples of final density, depending on green density and $T_1$ temperature are shown in Table VIII, for $SiB_6$/$SiB_4$ - 30 volume percent Al.

TABLE VII

| Volume % $SiB_6$/$SiB_4$ | Volume % Al Metal | % theoretical density |
|---|---|---|
| 100 | 0 | 69.3 |
| 90 | 10 | 80.1 |
| 80 | 20 | 91.2 |
| 80 | 20 | 91.2 |
| 75 | 25 | 95.7 |
| 70 | 30 | 99.8 |
| 60 | 40 | 100.0 |
| 50 | 50 | 100.0 |

TABLE VIII

| Initial heating temperature $T_1$ °C. | Density, % of theoretical 50* | 60* | 65* |
|---|---|---|---|
| 580 | 79 | 79 | 77 |
| 600 | 91 | 89 | 87 |

TABLE VIII-continued

| Initial heating temperature $T_1$ °C. | Density, % of theoretical | | |
|---|---|---|---|
| | 50* | 60* | 65* |
| 620 | 100 | 100 | 99 |
| 640 | 100 | 100 | 100 |

*greenware density

Figure 10:
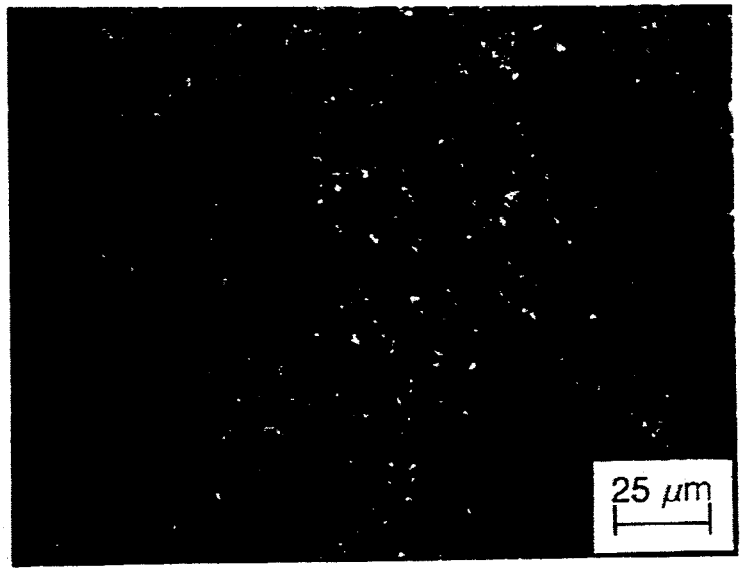
FIG. 10 is a SEM of a $SiB_6/SiB_4$ - 30 volume percent Al composite of the invention.

The microstructure of the $SiB_6/SiB_4$ - Al composites produced is characterized by a homogenous distribution of $SiB_6$ and $SiB_4$ in a continuous aluminum matrix, as shown in FIG. 10. $SiB_6/SiB_4$ 30 volume percent Al composites have a density of 2.5 g/cm$^3$ (100 percent theoretical), fracture toughness (measured by Chevron Notch technique) of 10.4–10.9 MPa.m$^{\frac{1}{2}}$, fracture strength (measured by 4 point bend test) of 80–90 kpsi (616 MPa) and hardness (Tukon microhardness tester with Knoop indentor) of 350–450 kg/mm$^2$.

EXAMPLE 6 - SiC-Al

Figure 11:
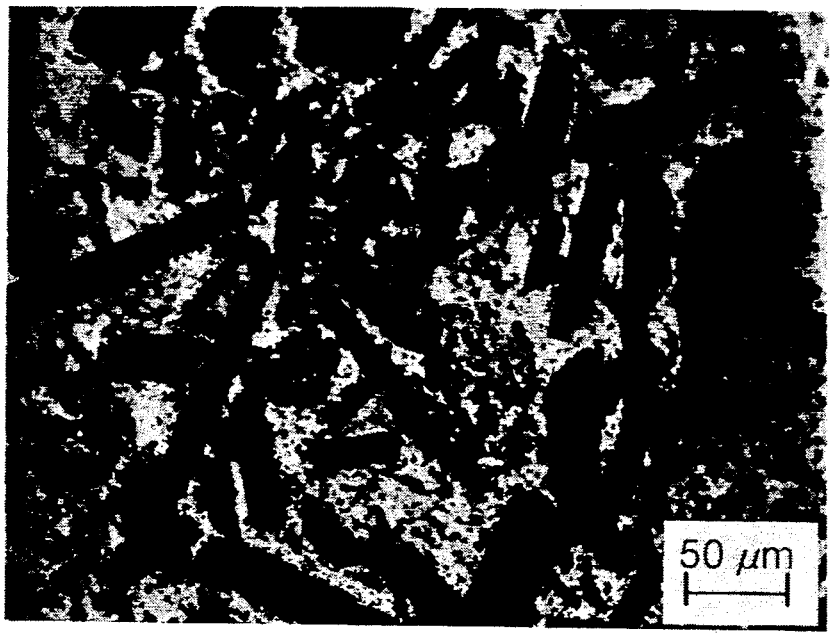
FIG. 11 is a SEM of a SiC - 50 volume percent Al composite of the invention.

SiC platelets from American Matrix Co. were used. The SiC material was characterized by particle sizes of 50–100 μm and a specific gravity of 3.2 g/cm$^3$. Al powder, having an average particle size of 6 μm (Alcoa) was characterized by a density of 2.7 g/cm$^3$. The ceramic and metal powders were mixed mechanically by a dry mixing process. The powder mixture was cold pressed at 5 ksi and isostatically pressed to 58 percent green density. The SiC - 50 volume percent Al composite was encapsulated in an Al container under vacuum and heated to 610° C. The temperature was stabilized for 10 minutes and then a pressure of 120 ksi was applied for 5 seconds. A density of 99.9 percent of theoretical composites were obtained. X-Ray diffraction did not show presence of $Al_4C_3$. FIG. 11 shows the microstructure of the densified composite.

The method described above was repeated utilizing a mixture of $SiB_6$ and 30 volume percent Cu. The $SiB_6$30 volume percent Cu greenware was heated to 1232° C. In this case Cu melted before the dynamic pressing step. The resulting composite had a density of 99.9 percent of theoretical. A scanning photomicrograph shows large copper lakes suggesting that wetting must be poor for this system. The presence of the large copper lakes suggests that a more homogeneous structure could be achieved by heating and dynamically pressing such that lower temperatures result.

The above-described method was repeated with a mixture of $SiB_6$ and 30 volume percent Si. Initial heating was to 1400° C. followed by the dynamic pressing step. Calculated density for the fully densified composite is 2.37 g/cm$^3$. Actual density was 2.38 g/cm$^3$. Grain sizes ranged from 30 to 40 micrometers.

What is claimed is:

1. A densified ceramic and metal composition, consisting of:

a ceramic, in an amount of at least 50 percent by volume of said composition, wherein said ceramic is selected from the group consisting of $SiB_4$, $AlB_2$, $Al_{12}C_2$, $Al_4BC$, MgO, mullite, AlN, $Si_3N_4$ or mixtures thereof; and a metal, wherein said metal is selected from the group consisting of Al, Mg, Ti, Fe, Ni, Co, Mn, Cu, Si, or their alloys, and said composition is substantially fully dense.

2. A densified ceramic and metal composition, consisting of:

a silicon boride in an amount of about 50–80 percent by volume of said composition, wherein said silicon boride is selected from the group consisting of $SiB_4$, $SiB_6$, $SiB_{14}$ or their mixtures; and at least one metal selected from the group consisting of Cu, Fe, Co, Si, Ni or their alloys.

3. The densified composition of claim 2 wherein the amount of silicon boride is about 50–75 volume percent of said composition.

4. The composition of claim 3 wherein said metal is Al and said composite is of a desired density, approaching 100 percent of theoretical density.

5. The composition of claim 3 wherein said metal is an aluminum alloy.

6. The composition of claim 3 wherein said metal is Cu and said composite is substantially 100 percent of theoretical density.

7. A densified ceramic and metal composition, consisting of:

$SiB_6$, in an amount of at least 50 percent by volume of said composition; and a metal, wherein said metal is selected from the group consisting of Mg, Ti, Fe, Ni, Co, Mn, Cu, Si, or their alloys, and said composition is substantially fully dense.

8. A densified ceramic and metal composition, consisting of:

a silicon boride in an amount of about 50–80 percent by volume of said composition, wherein said silicon boride is a mixture of $SiB_4$ and $SiB_6$; and a metal selected from the group consisting of aluminum and aluminum alloys.

9. The densified composition of claim 3 wherein the metal is aluminum, said densified composition having a density of from about 95 to about 100 percent of theoretical density.

* * * * *

UNITED STATES PATENT AND TRADEMARK OFFICE

CERTIFICATE OF CORRECTION

PATENT NO. : 5,143,540

DATED : September 1, 1992

INVENTOR(S) : Aleksander J. Pyzik, et al

It is certified that error appears in the above-indentified patent and that said Letters Patent is hereby corrected as shown below:

On the title page, in [Item] '75] Inventors, 4th line, "Pecnenik", should correctly read --Pechenik--.

Column 20, line 9, "$Al_{12}C_2$", should correctly read --$AlB_{12}C_2$--.

Signed and Sealed this

Third Day of May, 1994

Bruce Lehman

*Attest:*

BRUCE LEHMAN

*Attesting Officer*

*Commissioner of Patents and Trademarks*